United States Patent [19]

Johnston

[11] Patent Number: 4,744,320

[45] Date of Patent: May 17, 1988

[54] BOAT HULL AND METHOD OF FABRICATION

[76] Inventor: Daniel D. Johnston, 1601 #62 Oro Vista Rd., San Diego, Calif. 92154

[21] Appl. No.: 14,244

[22] Filed: Feb. 12, 1987

[51] Int. Cl.[4] ..... B63B 3/00

[52] U.S. Cl. ..... 114/65 R; 114/83; 114/356; 114/359

[58] Field of Search ..... 114/65 R, 78, 79 R, 114/79 W, 80–88, 355–359

[56] References Cited

U.S. PATENT DOCUMENTS

| | | | |
|---|---|---|---|
| 1,859,374 | 5/1932 | Orkin | 114/355 |
| 2,165,545 | 7/1939 | Grant | 114/355 |
| 2,322,160 | 6/1943 | Schlagel | 114/356 |
| 2,400,771 | 5/1946 | Moxham | 114/65 R |
| 2,572,623 | 10/1951 | Hoppenstand | 114/356 |
| 3,156,210 | 11/1964 | Lyon | 114/356 |

*Primary Examiner*—Joseph F. Peters, Jr.
*Assistant Examiner*—Stephen P. Avila
*Attorney, Agent, or Firm*—Baker, Maxham & Jester

[57] ABSTRACT

A boat hull is constructed of a plurality of unitary plates connected together along their edges and connected to an internal frame at the edges, such that the side deck and bottom plates of the hull are connected solely at their respective edges to the internal frame, with the plates being spaced outward from the frame intermediate the connections, and with an elastomer disposed in the space between the frame members and the hull plates.

13 Claims, 3 Drawing Sheets

FIG. 3
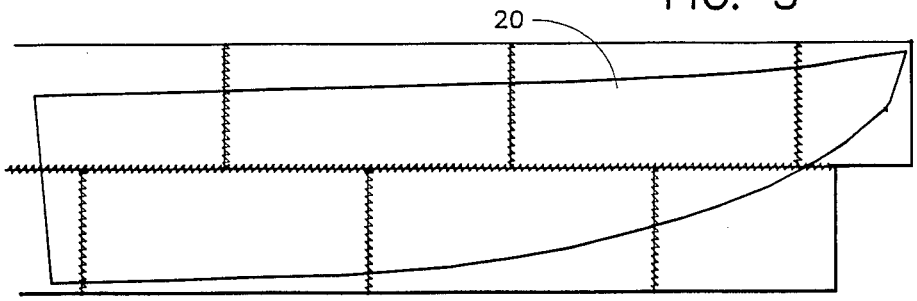
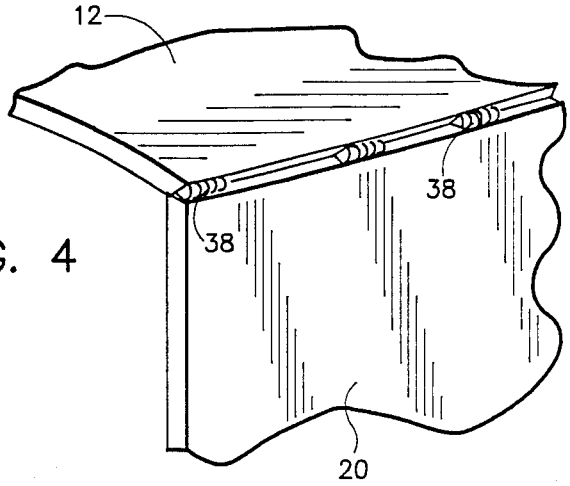
FIG. 4
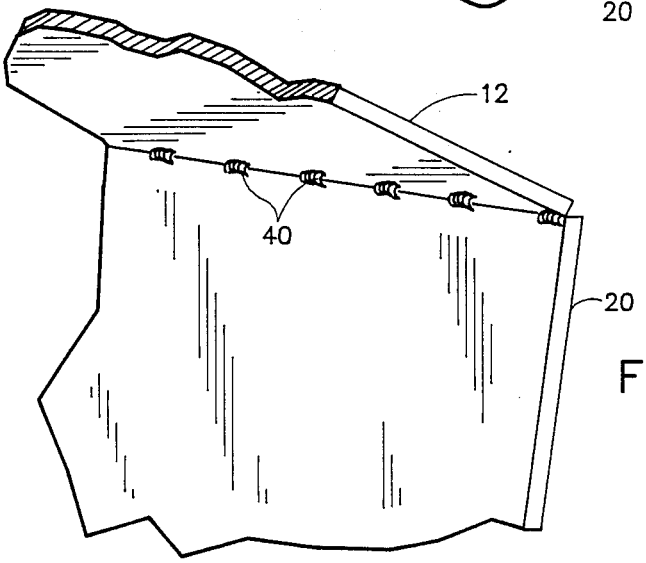
FIG. 5

BOAT HULL AND METHOD OF FABRICATION

BACKGROUND OF THE INVENTION

The present invention relates to metal hull boats, and pertains particularly to a hull structure and method of forming the structure.

At the present time, most metal ship construction is accomplished by the welding or joining of hull plates or sheets rigidly to a multiplicity of lateral frames and longitudinal stringers. The heat generated by the welding of the plates induces temperature gradients, such that when the welded joints cool to ambient, temperature plate distortion occurs between the frames and the stringer. The internal stress in small fabricated structures is relieved by placing the structure in a furnace, raising the temperature and holding it for a predetermined period of time, and slowly cooling the structure back to ambient temperature.

Very large boats and ships are frequently too large to treat in this manner. Accordingly, such stresses as are built into the ships and the like are accepted as state of the art commercial practice.

The present hull system and method of construction avoids this problem and creates a durable, high strength boat hull structure.

SUMMARY AND OBJECTS OF THE INVENTION

It is the primary object of the present invention to provide an improved boat hull and an improved method of fabrication.

In accordance with the primary aspect of the present invention, a boat hull is formed of unitary deck, side and bottom plates joined along their edges and selectively joined only at the edges to the internal boat hull frame. The hull plates are formed in a compound curvature and bow outward from the frame structure between the positions of joining to the framework at the edges of the plates. An elastomeric material is disposed between the hull plates and the frame members in the space between the joint thereto.

BRIEF DESCRIPTION OF THE DRAWING

The above and other objects and advantages of the present invention will become apparent from the following description when read in conjunction with the drawings wherein:

FIG. 3 is a plan view showing the formation of a hull plate;

FIG. 4 is an enlarged partial exterior perspective view showing a stage of the fabrication at one corner of the boat of FIG. 1;

FIG. 5 is an enlarged partial interior view of another stage of fabrication of the corner of the hull of FIG. 4;

DETAILED DESCRIPTION OF A PREFERRED EMBODIMENT

Figure 1:
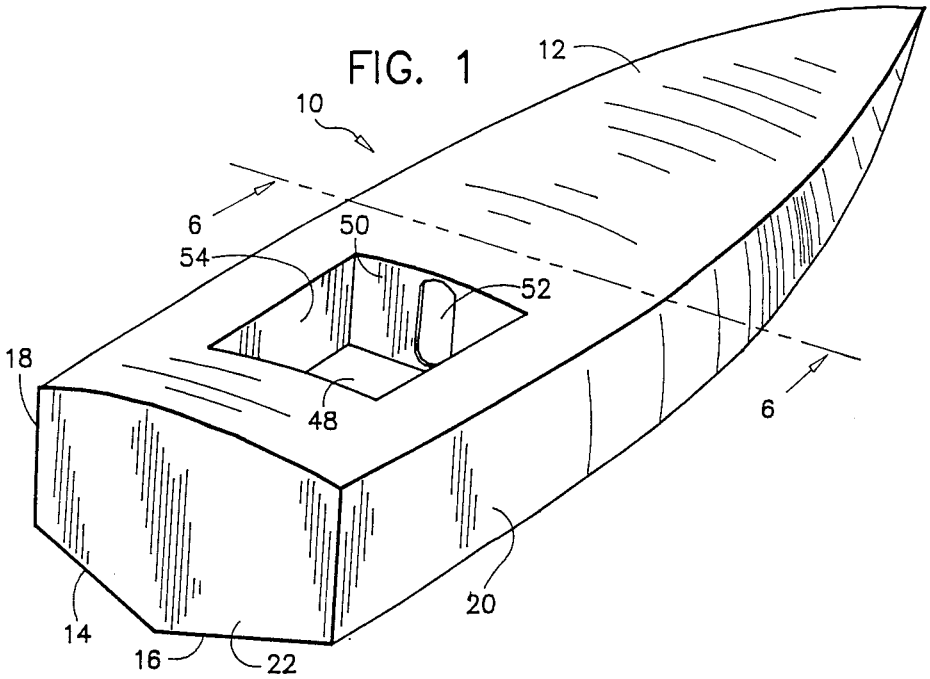
FIG. 1 is a perspective of a boat hull in accordance with the present invention.

Referring to FIG. 1 of the drawings, a boat hull designated generally by the numeral 10 is of a somewhat conventional shape and configuration. The hull, in accordance with the present invention, comprises a unitary deck plate 12, a unitary bottom plate or pair of bottom plates 14 and 16, and a pair of unitary side plates 18 and 20, and a transom or end plate 22. These plates are each preferably a single unitary plate prior to joining to form the hull. The bottom may have a single plate or multiple plates depending on its configuration.

Figure 2:
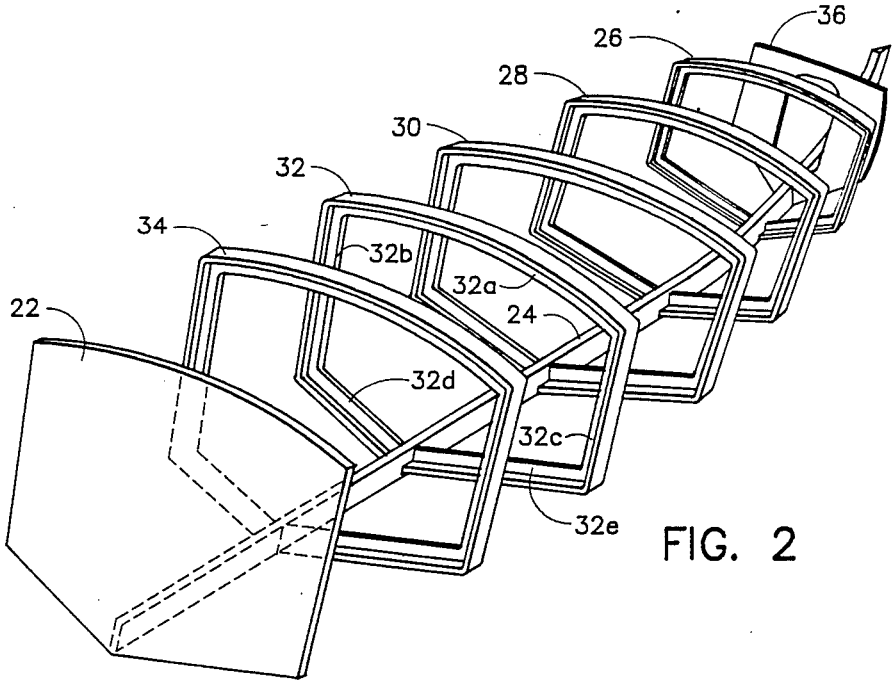
FIG. 2 is a perspective view showing the hull frame work.
Figure 7:
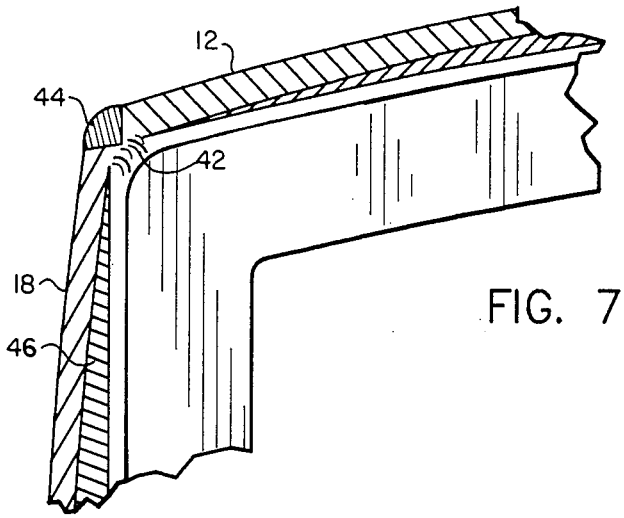
FIG. 7 is an enlarged partial view showing details of a corner connection.

The boat or ship is built up in somewhat of a conventional fashion, as shown in FIG. 2, in that a keel 24 may be laid down or supported and a plurality of internal frame members 26, 28, 30, 32 and 34 are secured to the keel 24, or in the alternative held in place by means of a jig or the like. A bulkhead 36 and a transom or end plate 22 may be similarly secured to the keel 24. With the framework in place, hull plates are then secured around and to the frame in a manner as will be described. The frame members each form a loop and are all identical except as to size. The frame member 32, for example, includes an top member or rib 32*a*, vertical side ribs 32*b* and 32*c* and bottom ribs 32*d* and 32*e*.

Referring to FIG. 3, there is illustrated a side plate 20, which for purposes of illustration has been made up of a plurality of plates of a smaller size by joining the plates by welding in a flat pattern. The side plate or the plate being formed is then cut from the large plate, and the welds then ground or removed to provide a flat uniform surface of the plate. This is a necessary construction for very large boats. For smaller boats, plates or sheets of a totally unitary structure for forming the panels may typically be available. The plates are selected of a thickness to be self supporting, i.e. have sufficient thickness to support itself.

The deck plate can usually be of a unitary structure, but in most instances will be formed to accommodate a cockpit or a cabin. The illustrated embodiment shows a cockpit having a bottom or floor 48, a front wall 50 having a port or opening 52, side walls 54 (only one shown) and a back wall, not shown. The deck plate 12 is otherwise a unitary structure. The cockpit may be constructed after the hull has been completed.

After the plates have been formed, the edges of the plates where they joint an adjacent plate are bevelled such that an angle of between thirty-five and forty-five degrees exists between the plates for welding purposes. The plates are then fit together and tack welded from the exterior in the bottom of the weld joints as shown in FIG. 4, thus laying up the sheets around the frame. In most instances, the tack welding can be carried out in just about any order. However, it is preferably carried out from one end of the weld joint to the other. The heat generated by the welding has been found to aid in the shaping of the sheets so that they form compound curve shaped around the frame.

After the sheets have been tacked together around the frame, the plates are then stitch welded at 40 on the interior, as shown in FIG. 5. The interior welds are preferably of a continuous uniform pattern of welding, with care of accuracy and spacing. The welding is preferably carried out in a continuous uniform movement, for example, from the stern to the bow of the boat. The welding pattern is on the order of, for example, one inch joints with a three inch spacing between the joints. The plates are then similarly welded to the frame by welds 42 inboard at the juncture of the respective plates, solely at the corners of the frame.

Figure 6:
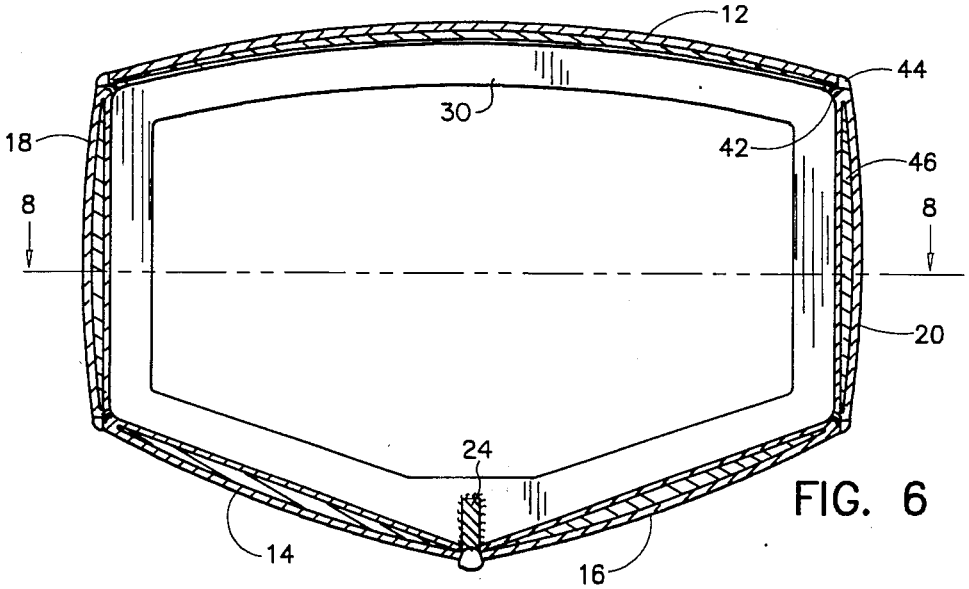
FIG. 6 is a section view taken generally on lines VI—VI of FIG. 1.
Figure 8:
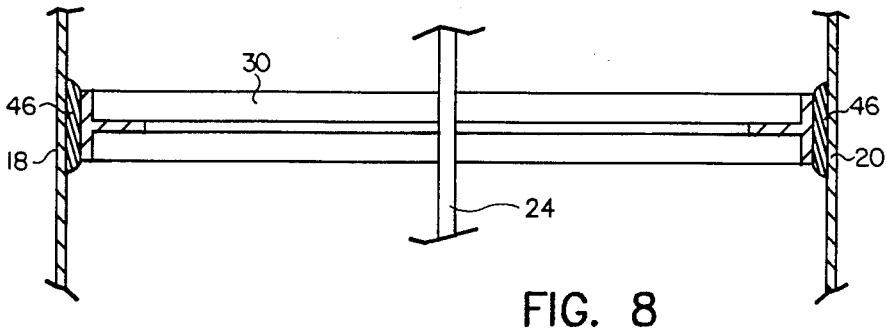
FIG. 8 is a view taken on line VIII—VIII of FIG. 6.

Following the stitch welding of the plates, the tack welds 38 are removed by grinding or the like to permit full penetration welding of the joints. The plates have been formed around the frame, as shown in FIG. 6, and a full penetration longitudinal weld 44 is then applied to the joint between the plates. This weld is made in intermittent sequence welds fore and aft in a manner that permits the plating to expand and contract to form the compound curving away from the framing, as shown in FIG. 6.

The forming of the plates and shaping of them results in the plates taking on a compound curvature conforming to the general shape of the hull, and at the same time curving outward, as shown in FIG. 6, away from the internal frame member. This leaves a spacing between the plates and the frame between the corner joints, as shown in FIG. 6. After the full penetration longitudinal welds have been completed, the hull is shaped and secured to the framework as illustrated. The final and only vertical welds are now performed at the transom and stern post. The vessel is now permitted to stand in a controlled environment for 24 hours to facilitate uniformity of temperature throughout the structure.

A quantity of a catalyzed elastomeric material 46 is then injected between the rib or frame members and the plates of the hull. A suitable elastomeric material, preferably with a shore hardness of approximately twenty-eight degrees is preferably used. Catalyzed elastomers provide a failrly strong bond between the hull and the frame and permits the hull to yield or flex under impact.

One typical vessesl that has been constructed in accordance with the invention has a length of thirty-five feet, a beam of eight feet six inches, with a draft of two feet five inches and a weight of about forty-three hundred and fifty pounds. The vessel was constructed of 5086H116 aluminum alloys and specific plating schedules, including a bottom plate of three-eighths inch, a top side plating of one-quarter inch, decks of three-sixteenths, and cockpit of five-thirty seconds.

The welding technique applied to the vessel employs a heat transfer welding system technique. This technique and system pre-stresses a compound curve in the plating of the vessel, which changes the density of the material creating an extremely hard aluminum plate structure. The joining of the plates to the frame in the specified locations, as illustrated, provides a shock type mounting of the plates to the frame. This creates an anti-vibration, anti-shock system as well as provides the shell with impact resistance from concentrated impacts, such as collision resistance and projectile resistance, such as from bullets and the like.

The interior frames of the illustrated structure may be made from extruded three-eighths inch aluminum stock having a T cross-section. These frames are mounted for example on twenty inch center lines. This technique of construction employing the heat transfer weld system to create the shell plating with compound curves, pre-stresses the plating and in turn yields a much stronger shell. This eliminates the need for additional interior framing and bulkheads to support shell plating.

A hull having this structure and constructed in accordance with the above described process will have a number of advantages over conventional hulls. Among the advantages are that the stress of the plating will be more evenly distributed to the frames via the elastic compound between them. The outer plate will be free from corrugations, depressions and irregularities generally associated with ships built in a conventional manner.

A hull of a given weight in accordance with the invention will demonstrate greater structural integrity than a hull of equal weight built in a conventional manner. This has been demonstrated in an actual comparison test between a hull of conventional construction and one in accordance with the present invention, both hulls being of the same thickness. The test involved firing 14 millimeter projectiles at point blank range at both hulls. The projectiles passed through the conventional hull but failed to pass through the hull of the invention. In the hull of the invention, the energy from the projectiles was dissipated over a much greater area and via the elastomer to the frame.

The present invention is applicable to vessels constructed of substantially any metal. Certain aspects of the process and the results may vary with different metals because of the memory of the particular metal. The process is very well suited to aluminum boat hulls as described herein.

While I have illustrated and described my invention by means of a specific embodiment, it is to be understood that numerous changes and modifications may be made therein without departing from the spirit and scope of the invention as defined in the appended claims.

I claim:

1. A method of fabricating a metai boat hull comprising the steps of:

selecting and forming an internal frame;

selecting a unitary plate having edges for each side and for the deck;

selecting at least one unitary plate having edges for the bottom;

forming the edges of the plates with an angle therebetween of about thirty-five to forty-five degrees;

securing the side plates to the deck plate and to the bottom plate along the edges thereof; and securing the plates to the frame solely at the edges of the plates in a manner to curve away from said frame.

2. A method of fabricating a metal boat hull according to claim 1 wherein:

the step of securing the plates together comprises:

tack welding the plates together;

stitch welding the plates together on the interior; and welding the plates with a full penetration weld along the exterior edge thereof.

3. A method of fabricating a metal boat hull according to claim 2 wherein:

the step of selecting the plates includes selecting aluminum plates having a thickness sufficient for self supporting.

4. A method of fabricating a metal boat hull according to claim 2 further comprising:

selecting and placing an elastomer between said plates and said frame in the region between the edges of the plates.

5. A metal boat structure comprising:

an internal support frame;

a deck plate for covering a deck area and having side edges for mating with side plates;

unitary port and starboard side plates, each formed with a compound curve forming opposed convex and concave surfaces for covering a side of a hull and having top and bottom edges; and a bottom plate formed with a compound curvature defining opposed convex and concave surfaces and having side edges, said plates being secured together at said edges thereof and to said frame solely at spaced positions along said edges so that each plate curves away from said frame between the edges thereof.

6. A metal boat structure according to claim 5 wherein:

an elastomeric material is disposed between said plates and said frame.

7. A metal boat structure according to claim 5 wherein:

said frame comprises a plurality of vertical ribs spaced longitudinally along said hull.

8. A metal boat structure according to claim 5 wherein:

said plates are aluminum.

9. A metal boat structure according to claim 8 wherein:

said frame comprises a plurality of vertical ribs spaced longitudinally along said hull.

10. A metal boat structure according to claim 9 wherein:

an elastomeric material is disposed between said plates and said vertical ribs.

11. A metal boat hull structure comprising:

an internal frame including a keel and a plurality of vertical ribs spaced along said keel;

a unitary deck plate for covering a deck area and having side edges for securing to adjacent plates;

unitary port and starboard side plates for covering an entire side and each having top and bottom edges for securing to adjacent deck and bottom plates; and a bottom plate having side edges, said plates being formed of a compound curvature forming opposed convex and concave surfaces, said plates being secured together along the edges thereof and to said ribs at the edges of the plates, said plates being curved outward away from said ribs between said edges forming a space therebetween.

12. A metal boat structure according to claim 11 wherein:

said space between said plates and said ribs are filled by an elastomeric material disposed solely between said plates and said ribs.

13. A metal boat structure according to claim 12 wherein:

said plates are aluminum and of a thickness to be self-supporting.

* * * * *